United States Patent [19]

Brüngger et al.

[11] Patent Number: 4,625,660

[45] Date of Patent: Dec. 2, 1986

[54] AUXILIARY APPARATUS FOR DISCHARGING INCINERATION RESIDUES OF FURNACES, PARTICULARLY REFUSE INCINERATORS

[75] Inventors: Walter Brüngger, Gross; Peter A. Cerny, Bellikon, both of Switzerland

[73] Assignee: Von Roll AG, Gerlafingen, Switzerland

[21] Appl. No.: 765,550

[22] Filed: Aug. 14, 1985

[30] Foreign Application Priority Data

Sep. 12, 1984 [CH] Switzerland ..... 4358/84

[51] Int. Cl.[4] ..... F23J 1/00

[52] U.S. Cl. ..... 110/165 R; 110/171

[58] Field of Search ..... 110/170, 171, 165 R, 110/259

[56] References Cited

U.S. PATENT DOCUMENTS 946,553 1/1910 Mitchell ..... 110/170

4,048,928 9/1977 Martin ..... 110/171 X

FOREIGN PATENT DOCUMENTS 0105622 7/1982 Japan ..... 110/170

*Primary Examiner*—Edward G. Favors

*Attorney, Agent, or Firm*—Bachman & LaPointe

[57] ABSTRACT

An auxiliary apparatus with a trough or tank, to which the incineration residues are supplied by means of a drop shaft, a movable piston for moving the incineration residues from the trough to a discharge chute and at least one opening for inspecting and maintaining the trough arranged in a side wall at the latter and provided with a door. A plate, which can be inserted through the opening in the trough, is positioned in front of the front face of the piston. The plate is held on the chute walls by locking devices and is supported on the piston by adjusting mechanisms. The front face of the plate assembled from two parts is, for the same width, twice as high as the front face of the piston. The adjusting mechanisms are constructed as an adjustable arrangement of push rods or as pneumatic or hydraulic lift cylinders. The locking devices are constructed as automatic clamping devices or as brake linings which can be pressed against the wall, or they comprise a rail arranged on the wall and an arresting mechanism arranged on part of the plate, said rail and said arresting mechanism being in engagement with one another.

13 Claims, 10 Drawing Figures

AUXILIARY APPARATUS FOR DISCHARGING INCINERATION RESIDUES OF FURNACES, PARTICULARLY REFUSE INCINERATORS

BACKGROUND OF THE INVENTION

The invention relates to an auxiliary apparatus for discharging incineration residue from furnaces, particularly refuse incinerators, with a trough or tank to which the incineration residues are supplied by means of a drop shaft, a movable piston removing the combustion residues from the trough to a discharge chute and at least through maintenance and inspection opening provided with a door and arranged in a side wall of the trough.

Apparatus of the aforementioned type are, for example, known from DE-OS No. 2,739,396 and DE-OS No. 2,539,615. However, in the case of the known apparatuses, it is only possible to discharge incineration residues from the trough to the chute by means of the piston when the drop shaft is sufficiently full with such residues. Thus, it is only then that, after each piston stroke, sufficient combustion residues can pass from the drop shaft to the trough to fill the piston stroke volume and form a plug, which is moved to the chute during the next stroke. In the case of the known apparatuses, the incineration residues can only be moved thorugh the chute when it is sufficiently filled with such residues. Thus, it is only then that each plug fed to the chute is able to advance the plug of the preceding stroke enabling the incineration residues to be gradually conveyed through the chute, plug by plug, until at the end of the chute they pass into a suitable transporting means for the removal thereof. Thus, it is disadvantageous in these apparatuses that in the case of faults in the vicinity of the drop shaft or the chute, the latter cannot be operated empty, i.e. the incineration residues must be hand shovelled through the maintenance opening. This always leads to a long operating stoppage and is linked with considerable accident risks for the workers working in the trough. In addition, the need to provide for the manual emptying of the incineration residues through the maintenance opening, means that in the vicinity of the latter and the trough a considerable amount of space must be left, inter alia for the parting and movement of transportation means for removing the incineration residues which have been shovelled out.

SUMMARY OF THE INVENTION

The problem of the present invention is to eliminate the aforementioned disadvantages and provide an apparatus of the aforementioned type which, even in the case of incomplete or inadequate filling of the drop shaft, does not have to be shovelled empty manually through the maintenance opening.

In accordance with the present invention the foregoing disadvantages are overcome. The present invention comprises an auxiliary apparatus for discharging incineration residue from furnaces, particularly refuse incinerators, which comprises: a trough or tank to which the incineration residues are supplied; a discharge chute communicating with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; and adjusting means for supporting the plate on the piston. Additional advantageous features may be seen from the ensuing specification.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
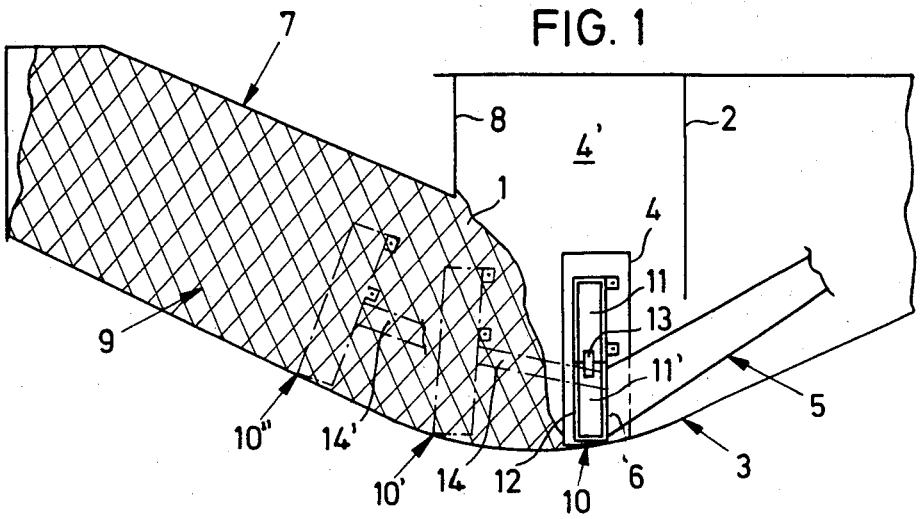
FIG. 1 is a diagrammatic side view of the apparatus according to the invention in section.

FIG. 1 is a side view of a construction of the apparatus according to the invention in diagrammatic sectional form. From a furnace, not shown, incineration residues 1 drop through a drop shaft 2 into a tank or trough 3, provided with a side wall 4' having an opening 4 for the inspection and maintenance of said trough or tank 3. Opening 4 can be closed by a door, not shown. A second side wall of trough 3, which is provided with an opening and a door, faces side wall 4' and cannot be seen in FIG. 1.

The front face 6 of a piston 5 moves the incineration residues 1 up to a chute 7. Piston 5 is shown in its retracted position, in which it largely frees opening 4, i.e. in this position of piston 5, opening 4 leads to the area in trough 3 in front of the front face 6 of piston 5. The stroke of piston 5 to its not shown extended position leads front face 6 roughly to the position where trough 3 passes into chute 7, i.e. roughly below wall 8 of drop shaft 2 which is furthest from piston 5.

In FIG. 1, drop shaft 2 is completely empty and trough 3 largely empty, e.g. because the apparatus is installed in a refuse incinerator and the refuse supply to the furnace has been interrupted. It can be seen that during each stroke of piston 5 only combustion residues which have dropped back from chute 7 into trough 3 are engaged by the front face 6 of piston 5 and that the incineration residue plug 9 is largely stationary. The following measures are taken in order to discharge plug 9 through the chute.

A plate 10, which can be in one or several parts and which e.g. comprises two superimposed parts 11, 11', is passed through opening 4 in front of front face 6 of piston 5. If parts 11, 11' have roughly the same height, each of the parts roughly covers the front face 6 of piston 5, so that the front face 12 of plate 10 for the same width is approximately twice as high as the front face 6 of piston 5. Each part 11, 11' can be separately introduced through opening 4 or through the facing opening into the trough or, as shown in FIG. 1, opening 4 can be dimensioned in such a way that parts 11, 11' already combined to form a plate 10 can be introduced into the trough together. As a function of the selected procedure parts 11, 11' are fixed to one another before or after introduction into trough 3, e.g. by screwing together. In the construction according to FIG. 1, the two parts 11, 11' are constructed as parallelepipedic, laterally open hollow profiles. In this case, the superimposed walls of parts 11, 11' which are to be connected are in each case accessible from the interior of said parts, can be provided with corresponding holes and fixed to one another by screws or equivalent fastening means 13.

If piston 5 with plate 10 placed in front of it is now brought into its extended position, piston 5 moves plate 10 into position 10'. By means of the hereinafter described fixing device, it is then possible to secure plate 10 in position 10', while piston 5 is returned to its retracted position. Plate 10 is then supported on the front face 6 of piston 5 by means of the hereinafter described adjusting mechanisms, in this case e.g. push rods 14, so that a further extension of piston 5 moves plate 10 into position 10''. The process can be repeated with the aid of longer push rods 14', so that plate 10 is finally moved through chute 7. It can be seen that plate 10 advances the incineration residues forming plug 9 or, during each extension of piston 5, moves them forward by one stroke length. Thus, the chute can be gradually emptied. As parts 11, 11' can be introduced through opening 4 into trough 3 by means of conventional mechanical lifting and conveying means, the present apparatus makes it unnecessary for workers to enter the trough in order to shovel it empty.

Figure 2:
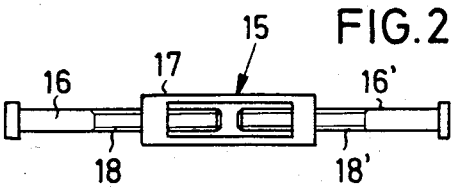
FIGS. 2 to 5 in each case are diagrammatic representations of the construction of an adjusting mechanism used in the apparatus according to the invention.

FIGS. 2 to 5 diagrammatically show a number of constructions of the adjustment mechanisms referred to hereinabove. In FIG. 2, the adjusting mechanism is constructed as a mechanically adjustable arrangement of push rods, covered by the reference numeral 15 and which essentially comprises two screw parts 16, 16' and a nut part 17. One of the threads 18, 18' of screws 16, 16' is left-handed and the other right-handed and correspondingly nut part 17 is provided with two oppositely directed threads. Devices of this type are known as adjustable tensioning or compressing devices and the presently described adjusting mechanism is constructed according to the same principle, but is constructed more strongly so as to permit the transfer to plate 10 of the thrust of piston 5.

Figure 3:
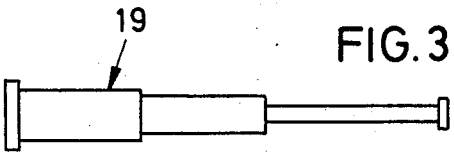

In FIG. 3, the adjusting mechanism is formed by a lift cylinder 19 which, e.g. as shown, is constructed as a double telescopic tube and is operable pneumatically or hydraulically, i.e. by the pressure of a fluid from a means not shown.

Figure 4:
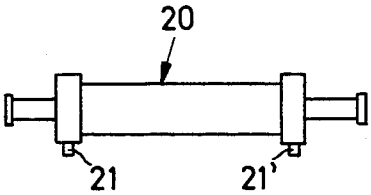

In FIG. 4, the adjusting mechanism is also a lift cylinder 20 and, as shown in exemplified manner, it is constructed so as to be double-acting and is operable by pneumatic or hydraulic means indicated by supports 21, 21'.

Figure 5:
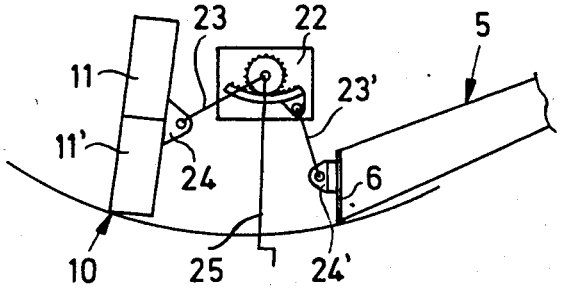

The adjusting mechanism diagrammatically shown in FIG. 5 essentially comprises two push rods 23, 23' connected by a worm gear drive. As shown, they are supported by means of cover plates 24, 24' on the front face 6 of piston 5 and/or on parts 11, 11' of plate 10. For example, the worm gear drive 22 is operated by means of crank 25.

In all cases, the adjusting mechanism is used and operated in such a way that plate 10, e.g. brought into position 10' by the extension of piston 5 is supported on the front face 6 of the piston 5 after its retraction, so that the next extension of piston 5 moves plate 10 into position 10''.

Figure 6:
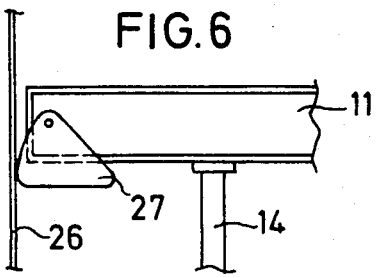
FIGS. 6 to 10 in each case are diagrammatic representations of a plan view of a locking device used in the apparatus according to the invention.

In order to secure plate 10 in position 10' of 10'' during the retraction of piston 5, it is possible to use the locking devices diagrammatically shown in FIGS. 6 to 10. FIG. 6 shows a beam-like part 11 of plate 10, a push rod 14 and a wall 26 of chute 7 in partial diagrammatic form. Wall 26 of chute 7 and wall 8 of drop shaft 2 are areas of the same planar wall which constantly pass into one another, at least on the side thereof facing the incineration residues 1. The locking device construction shown in FIG. 6 is an automatic clamping device 27 based on the principle of the cam, which is arranged in rotary manner on part 11 of plate 10 and is e.g. pressed against wall 26 by spring tension. This clamping device 27 permits the advance of plate 10 during the extension of piston 5, but opposes the slipping back of plate 10 during the retraction of piston 5. A similar clamping device is arranged on the opposite side of plate 10 for locking on the opposite chute wall, so that plate 10 is held on the walls on either side.

Figure 7:
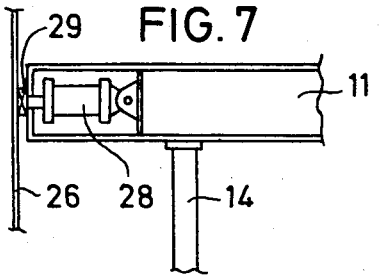

In the locking device construction shown in FIG. 7, the clamping action is achieved in that a lift cylinder 28 fixed to part 11 presses one or more brake linings 29 against wall 26, if it is hydraulically or pneumatically operated with not shown means.

Figure 8:
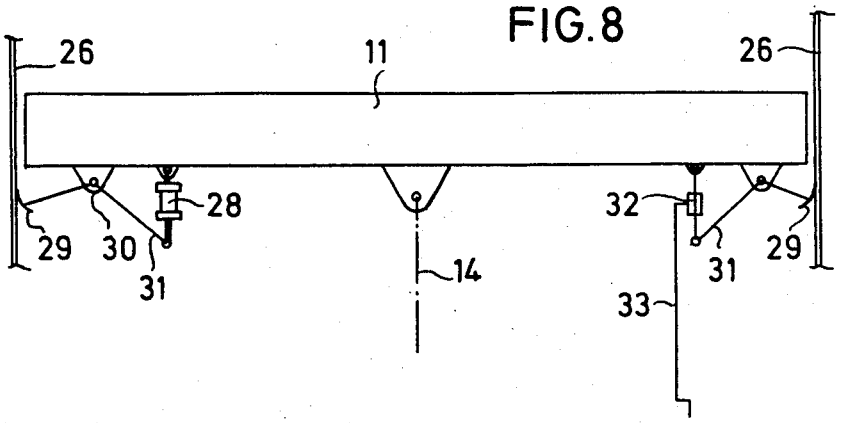

The left-hand half of FIG. 8 shows a variant of the construction of the locking device according to FIG. 7, in which the force on brake linings 29 exerted by lift cylinder 28 is transferred by a bent lever 31 articulated to cover plate 30.

The right-hand half of FIG. 8 shows a variant of the locking device construction shown in the left-hand half of FIG. 8, in which the force exerted on brake linings 29 by mechanical means is transferred by a bent lever 31 and comes from a worm gear drive 32, which can e.g. be operated hydraulically or pneumatically or, as shown, by a crank 33.

Figure 9:
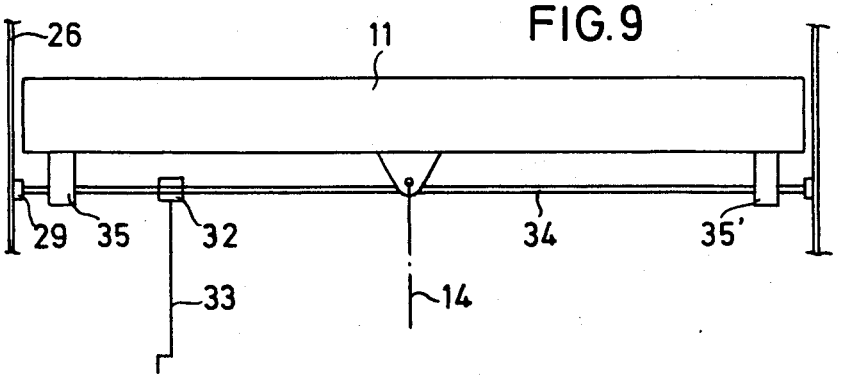

In a locking device construction diagrammatically shown in FIG. 9, the force exerted on brake linings 29 comes from a worm gear drive 32, as in the preceding construction, but in this case the force is transferred by means of a push rod 34, whose length is adjustable by drive 32 and which is guided in slide bearings 35, 35' arranged on part 11 of plate 10.

Figure 10:
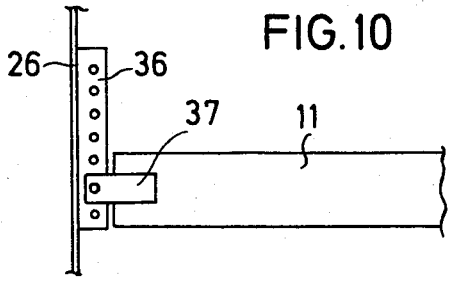

FIG. 10 diagrammatically shows a clocking device construction, in which a rail 36 constructed as a rack is located on wall 26 parallel to the direction of movement of part 11, the latter carrying an arresting mechanism 37 provided with a retaining pawl, which engages with the rack.

In a simplified construction, rail 36 is a perforated rail and arresting mechanism 37 is provided with a pin, which can be inserted in the holes of the perforated rail. The first variant functions according to the ratchet principle and permits the advance of the plate, but prevents it from slipping back. When using the second variant, the arresting mechanism must be released on each occasion when the plate is advanced by one piston stroke.

A locking device is obviously only necessary in those cases where there is a risk of the incineration residue plug dropping back and it can otherwise be eliminated.

Plate 10 can be made from wood, e.g. from railroad ties or the like. Thus, in this case, feed preferably takes place with spacing lumber, placed between the piston and the plate. If the plate 10 falls back into the initial position, it can be advanced again through lateral inspection openings by means of crowbars.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An auxiliary apparatus for discharging incineration residue from furnaces, particularly refuse incinerators, which comprises: a trough or tank to which the incineration residues are supplied; a discharge chute communicating with said trough; means for supplying said residues to said trough comprising a drop shaft communicating with said trough; a movable piston in said trough for removing the combustion residues from the trough to said discharge chute having a front face; a trough mintenance and inspection opening arranged in a side wall of the trough; a plate arranged in front of the front face of the piston, wherein the plate is in two parts, each of the two parts approximately covers the front face of the piston and is approximately twice as high as the front face of the piston; and adjusting means for supporting the plate on the piston.

2. An auxiliary apparatus according to claim 1 wherein the plate comprises assemblable parts.

3. An auxiliary apparatus according to claim 2 wherein the assemblable parts are constructed as parallelepipedic laterally open hollow profiles.

4. An auxiliary apparatus according to claim 1 wherein the plate is made from wood and including means for advancing said wood.

5. An auxiliary apparatus for discharging incineration residue from furnaces, particularly refuse incinerators, which comprises: a trough or tank to which the incineration residues are supplied; a discharge chute communicating with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; and adjusting means for supporting the plate on the piston comprising a nut part, from which push rods with oppositely directed threads project on either side.

6. An auxiliary apparatus for discharging incineration residue from furnaces, particularly refuse incinerators, which comprises: a trough or tank to which the incineration residues are supplied; a discharge chute communicating with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; and adjusting means for supporting the plate on the piston wherein the adjusting means is constructed as a double telescopic tube.

7. An auxiliary apparatus for discharging incineration residue from furnaces, particularly refuse incinerators, which comprises: a trough or tank to which the incineration residues are supplied; a discharge chute communicating with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; and adjusting means for supporting the plate on the piston comprising a lift cylinder acting on both sides.

8. An auxiliary apparatus for discharging incineration residue from furnaces, particularly refuse incinerators, which comprises: a trough or tank to which the incineration residues are supplied; a discharge chute communicting with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; and adjusting means for supporting the plate on the piston comprising two push rods connected by a worm gear drive.

9. An auxiliary apparatus for discharging incineration residue from furnaces, particularly refuse incinerators, which comprises: a trough or tank to which the incineration residues are supplied; a discharge chute communicating with said trough; means for supplying said residues to said trough; a movable piston in said trough for removing the combustion residues from the trough to said discharge chute having a front face; a trough maintenance and inspection opening arranged in a side wall of the trough; a plate arranged in front of the front face of the piston; a locking device on the plate for locking the plate on the walls of the chute; and adjusting means for supporting the plate on the piston.

10. An auxiliary apparatus according to claim 9 wherein the locking device is constructed as an automatic clamping device arranged eccentrically on the plate.

11. An auxiliary apparatus according to claim 9 wherein a locking device comprises at least one brake lining, which can be pressed against the wall by a lift cylinder.

12. An auxiliary apparatus according to claim 9 wherein a locking device comprises at least one brake lining, which can be pressed against the wall by mechanical means.

13. An auxiliary apparatus according to claim 9 wherein a locking device comprises a rail arranged on the wall and an arresting mechanism arranged on part of the plate, said rail and said arresting mechanism engaging with one another.

* * * * *